US006928255B2

(12) United States Patent
Mizuishi

(10) Patent No.: US 6,928,255 B2
(45) Date of Patent: Aug. 9, 2005

(54) IMAGE FORMING APPARATUS INCLUDING DEVELOPING GAP BETWEEN IMAGE AND DEVELOPER CARRIERS

(75) Inventor: Haruji Mizuishi, Ohta-ku (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/447,949

(22) Filed: May 30, 2003

(65) Prior Publication Data

US 2004/0009421 A1 Jan. 15, 2004

(30) Foreign Application Priority Data

May 31, 2002 (JP) ..... 2002-158514

(51) Int. Cl.[7] ..... G03G 15/08
(52) U.S. Cl. ..... 399/267
(58) Field of Search ..... 399/267, 270, 399/275, 272, 281, 279; 430/122, 111.4

(56) References Cited

U.S. PATENT DOCUMENTS 4,482,244 A * 11/1984 Yamazaki et al. ..... 399/356
4,885,466 A 12/1989 Koichi et al.
4,947,200 A * 8/1990 Kumasaka et al. ..... 399/231
5,812,919 A 9/1998 Takano et al.
5,822,667 A 10/1998 Hayama et al.
5,857,132 A 1/1999 Mizuishi et al.
5,873,019 A 2/1999 Mizuishi
5,887,224 A 3/1999 Mizuishi et al.
5,915,143 A 6/1999 Watanabe et al.
5,930,554 A * 7/1999 Godlove ..... 399/55
6,006,050 A 12/1999 Watanabe et al.
6,055,388 A 4/2000 Watanabe et al.
6,085,062 A 7/2000 Mizuishi et al.
6,088,563 A * 7/2000 Shimizu ..... 399/270
6,128,449 A 10/2000 Zenba et al.
6,144,811 A 11/2000 Ohori et al.
6,144,822 A 11/2000 Yamaguchi et al.
6,148,161 A 11/2000 Usui et al.
6,160,969 A 12/2000 Ishigaki et al.
6,266,501 B1 7/2001 Mizuishi et al.

FOREIGN PATENT DOCUMENTS

JP 11015271 A * 1/1999 ..... G03G/15/08
JP 2001-228706 8/2001

* cited by examiner

*Primary Examiner*—Quana Grainger
(74) *Attorney, Agent, or Firm*—Oblon, Spivak, McClelland, Maier & Neustadt, P.C.

(57) ABSTRACT

An image forming apparatus includes a latent image carrier that carries an electrostatic latent image, a developer carrier that carries a two-component developer containing toner and magnetic particles, and an electric field forming device that forms a developing electric field to develop the electrostatic latent image with the toner in a developing region where the developer carrier faces the latent image carrier. A magnetic brush is formed by magnetically adsorbing the two-component developer onto the surface of the developer carrier to develop the latent image with the toner in the magnetic brush. A developing gap between the developer carrier and the latent image carrier in the developing region is set so as not to press the toner in the magnetic brush against the surface of the developer carrier that faces a non-image portion of the latent image carrier and set so as not to fix the toner onto the developer carrier.

14 Claims, 6 Drawing Sheets

IMAGE FORMING APPARATUS INCLUDING DEVELOPING GAP BETWEEN IMAGE AND DEVELOPER CARRIERS

CROSS-REFERENCE TO RELATED APPLICATIONS

The present application claims priority to Japanese Patent Application No. 2002-158514 filed in the Japanese Patent Office on May 31, 2002, the disclosure of which is incorporated herein by reference.

BACKGROUND OF THE INVENTION

1. Field of the Invention

The present invention relates to an image forming apparatus such as a copying machine, a printer, a facsimile machine, or other similar image forming apparatus, and more particularly to an image forming apparatus in which an electrostatic latent image is visualized by use of a two-component developer including toner and magnetic particles.

2. Discussion of the Background

An image forming apparatus in which an electrostatic latent image on an image carrier is developed with a two-component developer has been widely used. In this type of image forming apparatus, a magnetic brush is formed by magnetically adsorbing a two-component developer including toner and magnetic particles onto the surface of a developer carrier. An electrostatic latent image formed on an image carrier is developed with toner in the magnetic brush that is transferred from the developer carrier to the electrostatic latent image on the image carrier under the influence of a development electric field.

In an image forming process generally performed in an image forming apparatus that is not limited to an image forming apparatus using a two-component developer, an image is transferred onto a transfer sheet by a transfer device, and the transferred image on the transfer sheet is fused by heat and is fixed onto the transfer sheet by applying pressure to the image in a heat fixing device (hereafter referred to as a "heat fixing process"). The image on the transfer sheet is formed from substances including at least black particles, that is, so-called toner.

The electric power consumed when a heat fixing device fuses an image by heat constitutes a majority of the electric consumption in an image forming apparatus. Recently, demands for reduction in the electric consumption in an image forming apparatus have increased in view of the need for energy savings. To satisfy these demands, it is required that an image should be fused and fixed at lower temperatures.

For the above-described reasons, a toner that can be fused at lower temperatures (hereafter referred to as a low-temperature fixing toner) has been under development in recent years. In one background heat fixing process, the lower limit of fixing temperature was generally in a range of about 150° C. to about 170° C. On the other hand, in another background heat image fixing process, the lower limit of fixing temperature is set to be not greater than 150° C. To achieve the desired reduction in electric consumption, the low-temperature fixing toners have been used.

However, the low-temperature fixing toner generally tends to have a strong adhesion force. Therefore, the low-temperature fixing toner gradually fixes to a developing sleeve in a developing device, thereby deteriorating the developing ability of the developing sleeve. The fixing of toner to the developing sleeve often occurs at an area of the developing sleeve which faces a non-image portion of an image carrier in a developing region.

FIGS. 1A and 1B are schematic views for explaining one mechanism for the adhering of toner to the surface of a developing sleeve in an image forming apparatus using a two-component developer including toner and magnetic particles. Specifically, FIG. 1A illustrates a condition when a developing sleeve 109 faces an image portion of a photoreceptor 101 serving as an image carrier. FIG. 1B illustrates a condition when the developing sleeve 109 faces a non-image portion of the photoreceptor 101. In this image forming apparatus, a toner moves by a potential difference between the developing sleeve 109 and the photoreceptor 101.

For example, when a toner is negatively charged, the potential of the surface of the photoreceptor 101 is −950V, and the voltage of, for example, −600V having a polarity equal to that of the toner is applied to the developing sleeve 109. When an exposure device irradiates the surface of the photoreceptor 101 with a laser beam, the potential of the image portion of the photoreceptor 101 is changed to about −100V. On the other hand, the potential of the background portion of the photoreceptor 101 is maintained at −950V.

In the above-described conditions, as illustrated in FIG. 1A, because an electric field between the developing sleeve 109 and the image portion of the photoreceptor 101 is directed from the image portion of the photoreceptor 101 charged at −100V to the developing sleeve 109 charged at −600V as indicated by an arrow (A) in FIG. 1A, the negatively charged toner moves in a direction indicated by an arrow (B) in FIG. 1A and is adhered to the image portion of the photoreceptor 101.

On the other hand, referring to FIG. 1B, because an electric field between the developing sleeve 109 and the non-image portion of the photoreceptor 101 is directed from the developing sleeve 109 charged at −600V to the non-image portion (i.e., the background portion) of the photoreceptor 101 charged at −950V as indicated by an arrow (C) in FIG. 1B, the negatively charged toner moves in a direction indicated by an arrow (D) in FIG. 1B and is adhered to the developing sleeve 109.

As illustrated in FIGS. 1A and 1B, the amount of toner adhered to the surface of the developing sleeve 109 in an area of the developing sleeve 109 which faces the non-image portion of the photoreceptor 101 is much greater than that of toner adhered to the surface of the developing sleeve 109 in an area of the developing sleeve 109 which faces the image portion of the photoreceptor 101.

In the case of background toner (not low-temperature fixing toner), even when the toner adheres to the surface of a developing sleeve, the toner is easily removed from the developing sleeve when the toner is rubbed. However, when a low-temperature fixing toner is adhered to the surface of a developing sleeve, the low-temperature fixing toner is not easily removed from the developing sleeve and is fused with time. As a result, the low-temperature fixing toner tends to be fixed onto the developing sleeve.

The above-described toner that is fixed onto the surface of the developing sleeve forms an insulating layer on the surface of the developing sleeve. This insulating layer obstructs the formation of the developing electric field, thereby deteriorating the developing performance of the developing sleeve.

Therefore, it is desirable to provide an image forming apparatus that can form a stable quality image while preventing the fixing of toner to a developing sleeve even when a low-temperature fixing toner is used.

SUMMARY OF THE INVENTION

According to one aspect of the present invention, an image forming apparatus includes a latent image carrier configured to carry an electrostatic latent image on a surface of the latent image carrier, a developer carrier configured to carry a two-component developer containing toner and magnetic particles on a surface of the developer carrier, and an electric field forming device configured to form a developing electric field to develop the electrostatic latent image on the latent image carrier with the toner in a developing region where the developer carrier faces the latent image carrier. A magnetic brush is formed by magnetically adsorbing the two-component developer onto the surface of the developer carrier. The latent image is developed with the toner in the magnetic brush while transferring the toner in the magnetic brush to the latent image. A developing gap between the developer carrier and the latent image carrier in the developing region is set so as not to press the toner in the magnetic brush against the surface of the developer carrier that faces a non-image portion of the latent image carrier and not to fix the toner onto the developer carrier.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
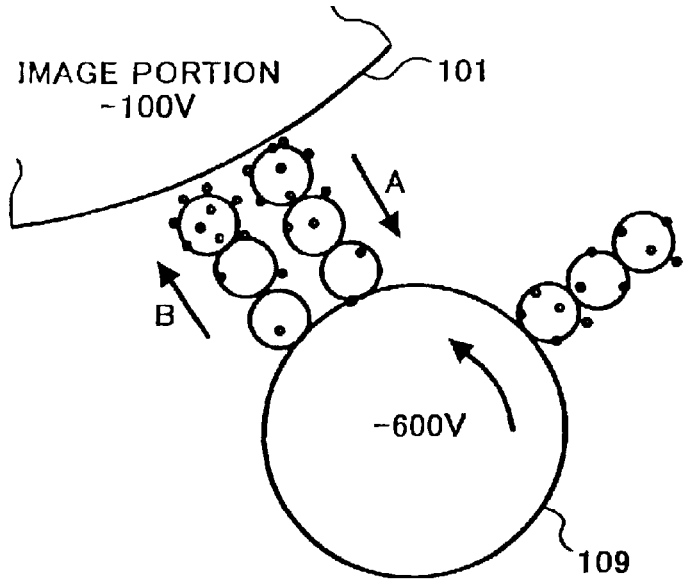
FIG. 1A is a schematic view for explaining a mechanism for the transferring of toner to an image portion of a photoreceptor in an image forming apparatus using a two-component developer.
Figure 1B:
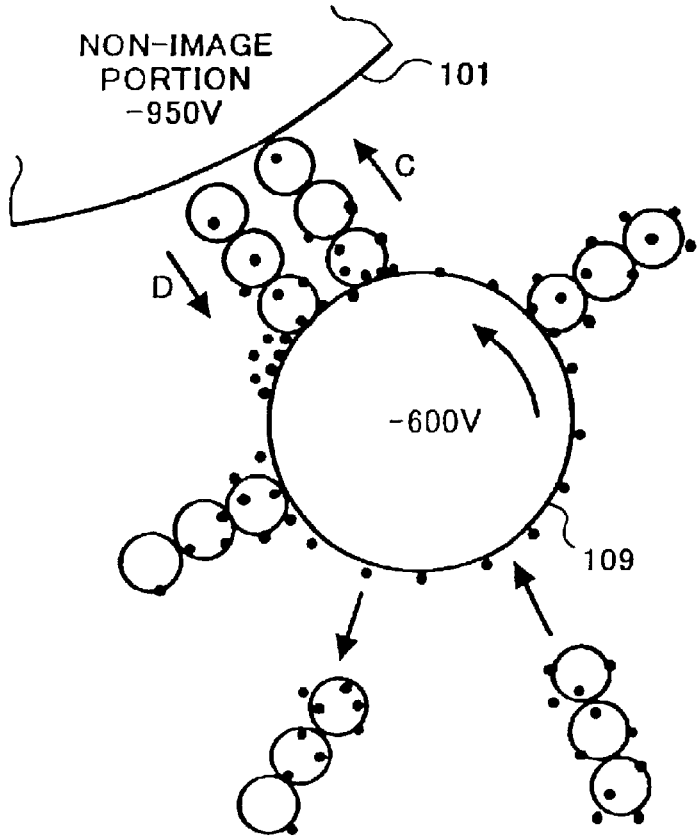
FIG. 1B is a schematic view for explaining a mechanism for the adhering of toner to a surface of a developing sleeve in the image forming apparatus using a two-component developer.

Preferred embodiments of the present invention are described in detail referring to the drawings, wherein like reference numerals designate identical or corresponding parts throughout the several views.

Figure 2:
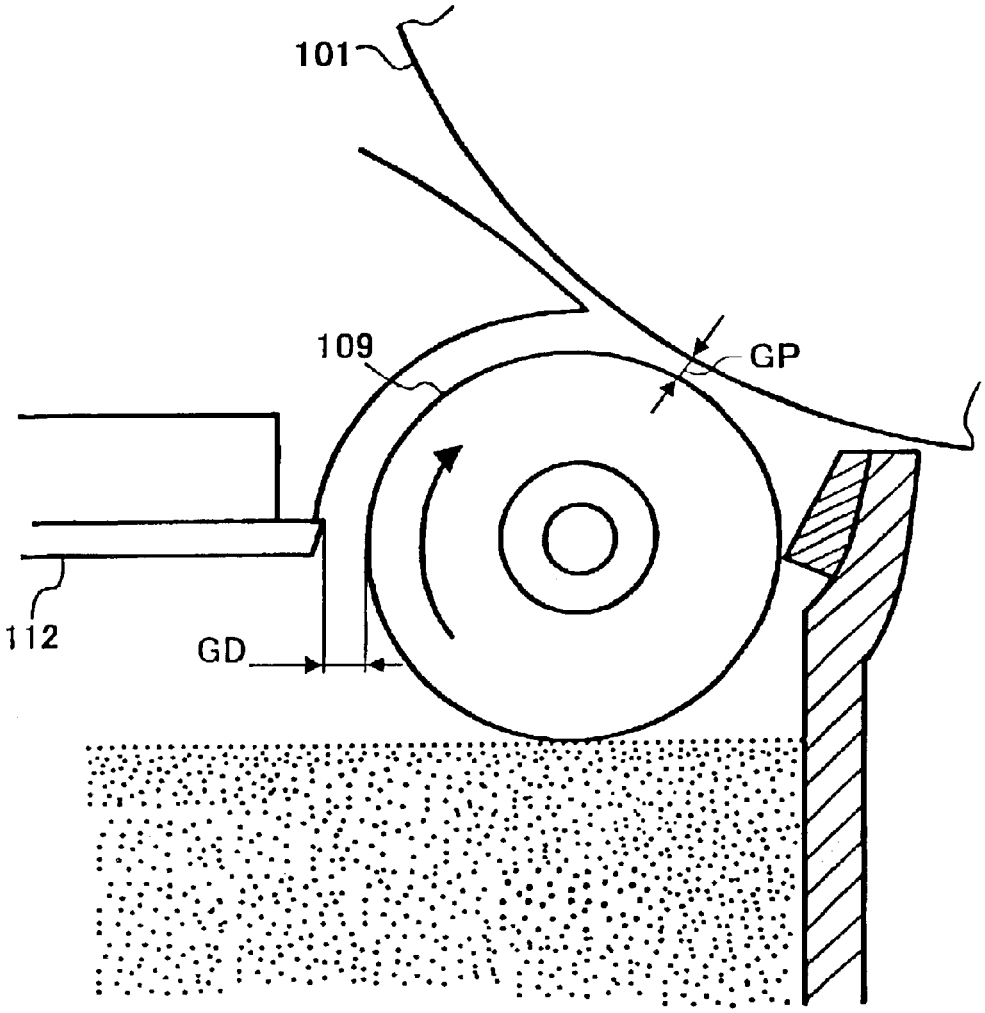
FIG. 2 is a partial enlarged view of a part adjacent to a developing region in a copying machine according to one embodiment of the present invention.
Figure 3:
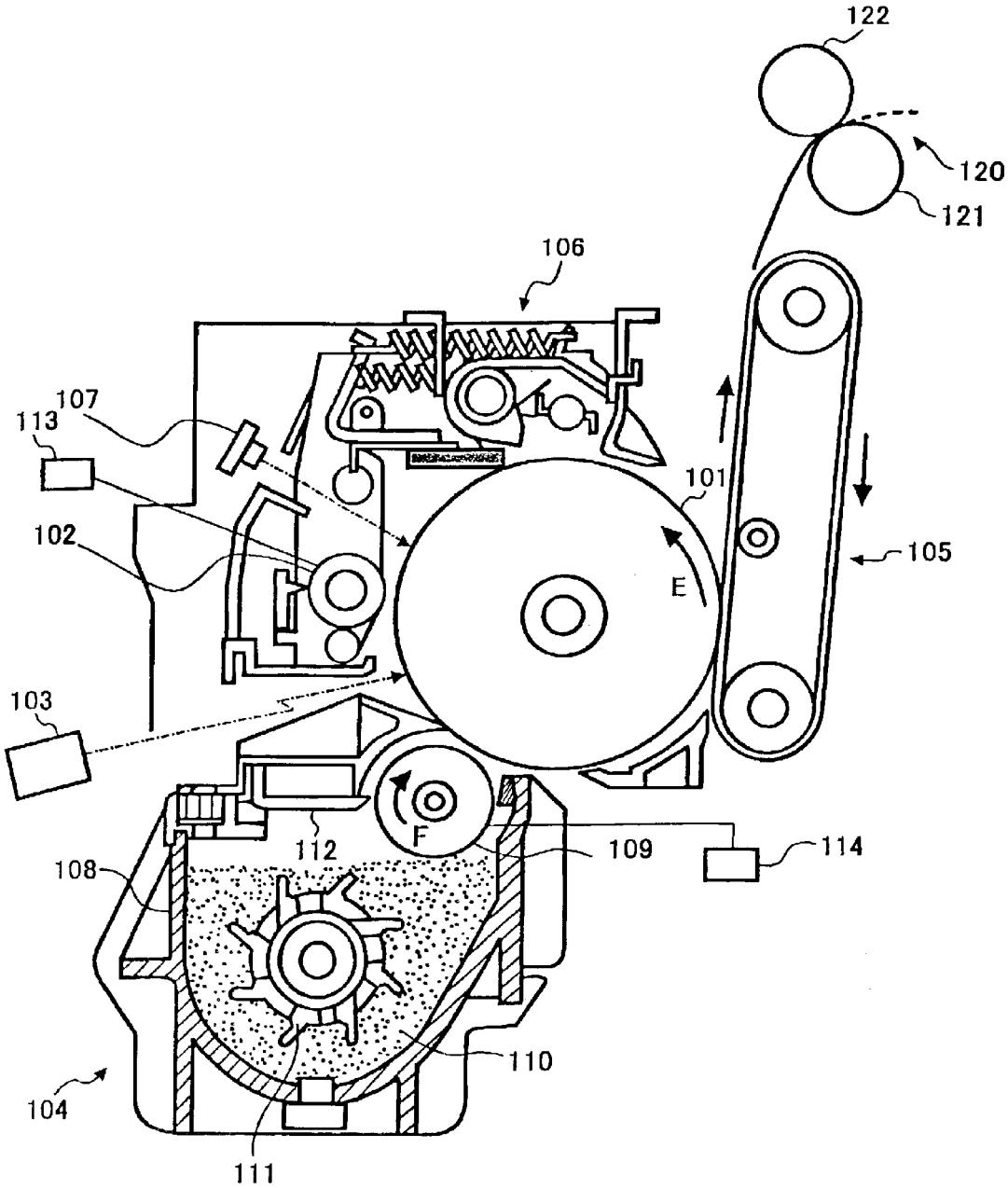
FIG. 3 is a schematic view of a main part of the copying machine according to one embodiment of the present invention.

FIG. 2 is a partial enlarged view of a part adjacent to a developing region according to one embodiment of the present invention. FIG. 3 is a schematic view of a main part of a copying machine according to one embodiment of the present invention. As illustrated in FIG. 3, a drum-shaped photoreceptor 101 serving as a latent image carrier is driven to rotate by a drive device (not shown) in a counterclockwise direction indicated by an arrow (E) on the photoreceptor 101 in FIG. 3. Arranged around the photoreceptor 101 are a charging roller 102, an exposure device 103, a developing device 104, a transfer device 105, a cleaning device 106, and a discharging device 107.

The charging roller 102 uniformly charges the surface of the photoreceptor 101. The exposure device 103 irradiates the uniformly charged surface of the photoreceptor 101 with a laser beam, thereby forming an electrostatic latent image on the surface of the photoreceptor 101. The developing device 104 supplies toner to the electrostatic latent image formed on the surface of the photoreceptor 101, thereby forming a toner image. The transfer device 105 transfers the toner image from the photoreceptor 101 onto a transfer sheet. The cleaning device 106 removes residual toner remaining on the surface of the photoreceptor 101 therefrom after the toner image is transferred from the photoreceptor 101 to the transfer sheet. The discharging device 107 discharges the surface of the photoreceptor 101 that has been subjected to the cleaning process. The above-described charging, exposure, developing, transferring, cleaning, and discharging processes are repeatedly performed.

The developing device 104 includes a developing case 108, a developing sleeve 109 serving as a developer carrier, an agitating member 111, and a doctor blade 112. The developing case 108 includes an opening on the side opposite to the photoreceptor 101. The developing sleeve 109 is disposed in the developing case 108 such that a part of the developing sleeve 109 faces the photoreceptor 101 through the opening of the developing case 108. The developing case 108 accommodates a developer 110. The agitating member 111 agitates the developer 110 and supplies the developer 110 to the surface of the developing sleeve 109. The doctor blade 112 serving as a layer thickness regulating member regulates the layer thickness of the developer 110 carried on the surface of the developing sleeve 109.

In the present embodiment, the developer 110 is a two-component developer including a mixture of magnetic carrier and non-magnetic toner. The detail of toner will be described below.

When the developer 110 is agitated by the agitating member 111, the toner in the developer 110 is charged by friction. The developing sleeve 109 includes a magnet (not shown) inside thereof. The developer 110 is magnetically adsorbed to the surface of the developing sleeve 109 by the magnetic force of the magnet and is carried on the surface of the developing sleeve 109 in a form of a magnetic brush. The developing sleeve 109 rotates in a direction indicated by an arrow (F) on the developing sleeve 109 in FIG. 3, and thereby the developer 110 carried on the surface of the developing sleeve 109 is conveyed to a developing region formed between the developing sleeve 109 and the photoreceptor 101 after the layer thickness of the developer 110 is regulated by the doctor blade 112. The toner attached onto the magnetic carrier in the developer 110 that is carried on the surface of the developing sleeve 109 is transferred toward the electrostatic latent image on the photoreceptor 101 under the influence of a developing electric field formed between the developing sleeve 109 and the electrostatic latent image on the photoreceptor 101. As a result, the toner adheres to the electrostatic latent image on the photoreceptor 101.

In recent years, in a generally used digital electrophotographic apparatus such as a laser beam printer, a digital copying machine, or other similar image forming apparatus, a photoreceptor is charged with a polarity equal to that of toner. In the present embodiment, when the toner has a negative polarity, the photoreceptor 101 is charged, for example, at −950V. A charging bias voltage is applied to the photoreceptor 101 from a charging bias power supply 113 via the charging roller 102. Further, a developing bias voltage having a polarity equal to that of the toner, for example, of −600V (may be in a range of about −600 V to −700 V) is applied to the developing sleeve 109 from a developing bias power supply 114. An electric field is formed between the photoreceptor 101 and the developing sleeve 109 by an electric field forming device constructed with the charging bias power supply 113 and the developing bias power supply 114.

Figure 4:
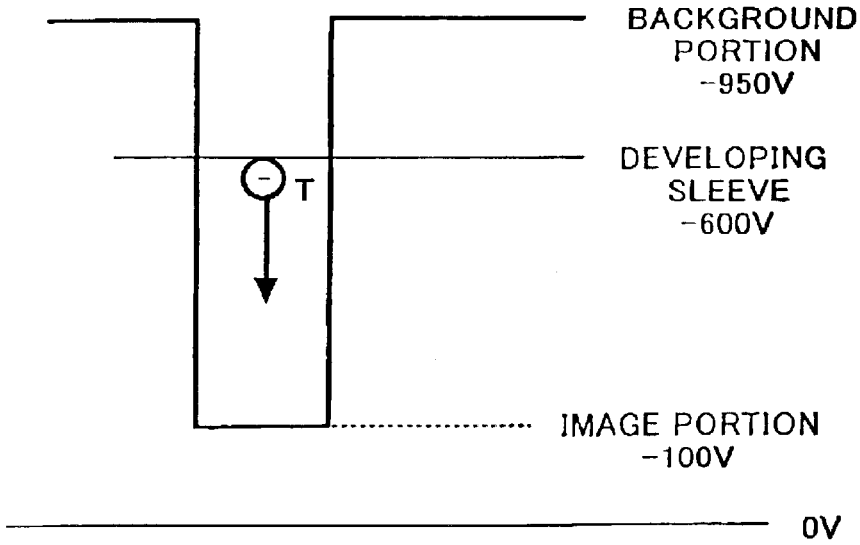
FIG. 4 is a schematic view for explaining the adhering of toner to an image portion of a photoreceptor from a developing sleeve.

In this condition, referring to FIG. 4, when the exposure device 103 irradiates the charged surface of the photoreceptor 101 with a laser beam, the potential of a background (i.e., non-image) portion of the photoreceptor 101 is maintained at about −950V, and the potential of an image portion of the photoreceptor 101 is changed to be at about −100V (may be in a range of about −100 V to 0 V). Because the electric field between the developing sleeve 109 and the image portion of the photoreceptor 101 is directed from the image portion having the potential of about −100V to the developing sleeve 109 having the potential of about −600V, a negatively charged toner (T) adheres to the image portion of the photoreceptor 101 as illustrated in FIG. 4.

On the other hand, because the electric field between the developing sleeve 109 and the background portion of the photoreceptor 101 is directed from the developing sleeve 109 having the potential of about −600V to the background portion of the photoreceptor 101 having the potential of about −950V, the negatively charged toner at this electric field is not adhered to the background portion.

The transfer device 105 transfers the toner image on the surface of the photoreceptor 101 to a transfer sheet. The transfer sheet having the transferred toner image is conveyed to a fixing device 120. The fixing device 120 includes a pair of fixing rollers 121 and 122. The toner image on the transfer sheet is heated, fused, and fixed onto the transfer sheet by applying heat and pressure to the toner image while the transfer sheet passes through a nip part between the fixing rollers 121 and 122. In this embodiment, the fixing device 120 employs a heat fixing method using a heater. In place of the heater, the fixing device 120 may employ a heat fixing method using an electromagnetic wave, electricity, or other similar heat fixing method.

When employing the above-described heat fixing method for fixing a toner image onto a transfer sheet, the electric power consumed when a fixing device fuses a toner image by heat constitutes a majority of the electric consumption in an image forming apparatus. Recently, demands for reduction in the electric consumption in an image forming apparatus have increased in view of energy saving. To satisfy these demands, it is required that a toner image should be fused and fixed at lower temperatures. Accordingly, a low-temperature fixing toner that can be fixed onto a transfer sheet at lower temperatures is required.

However, the low-temperature fixing toner generally tends to have a strong adhesion force. Therefore, the low-temperature fixing toner gradually fixes to a developing sleeve in a developing device, thereby deteriorating the developing ability of the developing sleeve. In the case of background toner (not low-temperature fixing toner), even when the toner adheres to the surface of a developing sleeve, the toner is easily removed from the developing sleeve when the toner is rubbed. However, when a low-temperature fixing toner is adhered to the surface of a developing sleeve, the low-temperature fixing toner is not easily removed from the developing sleeve and is fused with time. As a result, the low-temperature fixing toner tends to be fixed onto the developing sleeve.

In one embodiment of the present invention, the copying machine includes a construction which prevents the fixing of toner to the developing sleeve 109 even when a low-temperature fixing toner is used. The characteristics of the embodiment of the present invention will be described below.

The low-temperature fixing toner used in the copying machine according to the present embodiment contains at least a binder resin, a colorant, and a wax as a release agent. The molecular weight distribution of the toner exhibits at least one peak within the range of 1,000 to 10,000, the molecular weight distribution being measured by gel permeation chromatography (GPC) from a content soluble in tetrahydrofuran (THF). Further, the half peak width in the molecular weight distribution is set to 15,000 or less.

The measurement of GPC is carried out in the following manner. A column is fixed in a heated chamber of 40° C., and tetrahydrofuran (THF) serving as a solvent is caused to pass through the column at a flow rate of one milliliter per minute at 40° C. A 50 to 100 microliter THF solution containing 0.05 to 0.6 wt. % of a sample resin is injected into the column. The molecular weight distribution of the sample resin is determined by calculation based on the relationship between a logarithmic value and a count number read from a calibration curve. The calibration curve is obtained by plotting the logarithmic values and the count numbers of several kinds of monodisperse polystyrene standard samples. For calibration, the following polystyrene standard samples with molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$, which are available from for example, Pressure Chemical Co., or Tosoh Corporation, can be used. It is proper to use at least about ten standard polystyrene samples for preparing the calibration curve. A refractive index detector is used for the measurement.

By use of the above-described toner, even when the minimum fixing temperature is decreased by about 20° C., a toner image can be stably fixed to a transfer sheet at a low temperature as compared to a background low-temperature fixing toner. As one non-limiting example of the above-described low-temperature fixing toner, "Imagio toner type 18 (trademark)" manufactured by Ricoh company, Ltd. is used in this embodiment.

In the copying machine according to the embodiment of the present invention, toner is prevented from fixing to the developing sleeve 109 by setting an appropriately spaced developing gap (GP) between the developing sleeve 109 and the photoreceptor 101 in the developing region where the developing sleeve 109 faces the photoreceptor 101

The present inventor measured the density of toner on the developing sleeve 109 (hereafter referred to as a developing sleeve density (ID)) that faces a non-image portion of the photoreceptor 101 in the developing region while changing the values of the developing gap (GP) to examine a toner fixing condition on the part of the developing sleeve 109 that faces a non-image portion of the photoreceptor 101. The developing sleeve density (ID) was measured by use of a Macbeth reflection densitometer RD918 (trademark) manufactured by Macbeth Co.

Figure 5:
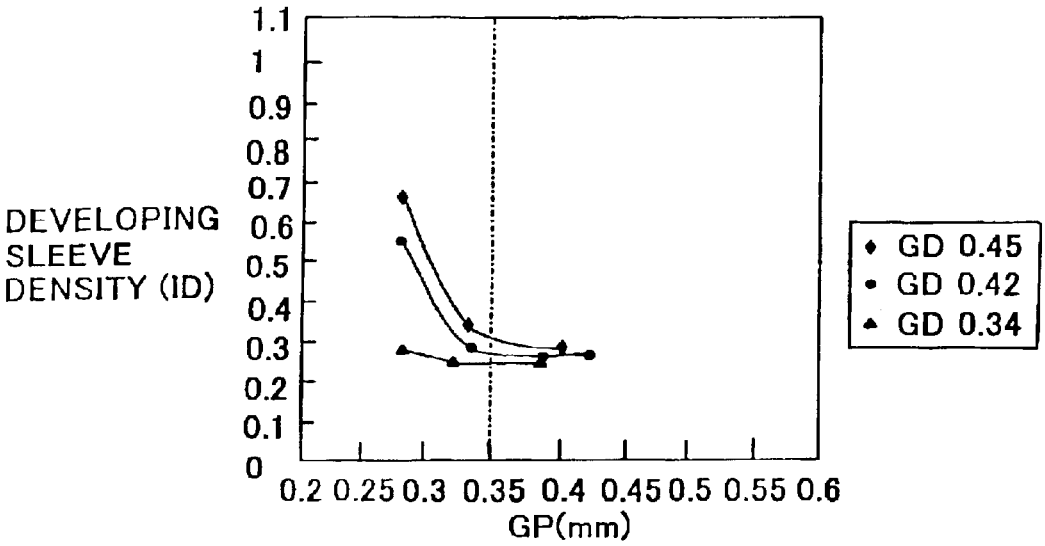
FIG. 5 is a graph showing a relationship between a developing sleeve density (ID), a developing gap (GP), and a doctor blade gap (GD) based on experimental results when using a new low temperature developer.
Figure 6:
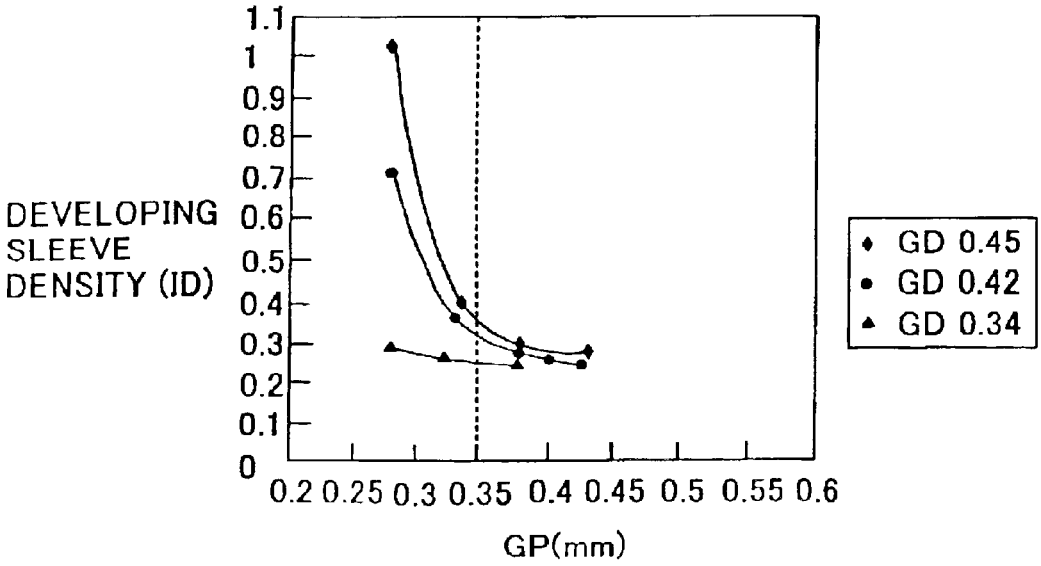
FIG. 6 is a graph showing a relationship between a developing sleeve density (ID), a developing gap (GP), and a doctor blade gap (GD) based on experimental results when using a developer that had been reused until 150,000 copies were produced.

FIG. 5 is a graph showing a relationship between a developing sleeve density (ID), a developing gap (GP), and a doctor blade gap (GD) based on experimental results when using a new developer. FIG. 6 is a graph showing a relationship between a developing sleeve density (ID), a developing gap (GP), and a doctor blade gap (GD) based on experimental results when using a developer that had been reused until 150,000 copies were produced (hereafter referred to as a "reused developer"). In the copying machine of the present embodiment, the carrier in the developer is continuously used after the toner is used for developing the electrostatic latent image on the photoreceptor 101. In addition, the residual toner removed from the surface of the photoreceptor 101 by the cleaning device 106 is also reused. The doctor blade gap (GD) represents a gap between the doctor blade 112 and the surface of the developing sleeve 109. In these experiments, the developing sleeve density (ID) was measured while changing the value of the doctor blade gap (GD) to 0.34, 0.42, and 0.45.

As seen from FIG. 5, when using the new low-temperature developer and when the developing gap (GP) is less than 0.35 mm, the developing sleeve density (ID) increases. The reason is that fixing of toner to the developing sleeve 109 occurs. When the value of the developing sleeve density (ID) is approximately 0.3, although the surface of the developing sleeve 109 is stained due to toner, the fixing of toner to the developing sleeve 109 does not occur.

Further, as seen from FIG. 6, when using the reused developer and when the developing gap (GP) is 0.35 mm, the value of the developing sleeve density (ID) is a slightly higher than that of the developing sleeve density (ID) when using the new developer. However, in this condition, an image is not affected by the toner on the developing sleeve 109. Referring to FIG. 6, when using the reused developer and when the developing gap (GP) falls below 0.35 mm, the acceleration of the developing sleeve density (ID) increases, because a toner tends to be fixed onto the developing sleeve 109 due to the seepage of wax from a reused toner and the reduction of additives in a reused toner.

According to the experimental results in FIGS. 5 and 6, in the copying machine that uses a low-temperature fixing toner, the toner is prevented from fixing to the developing sleeve 109 by setting the developing gap (GP) to be at least about 0.35 mm, preferably at least about 0.4 mm.

The reason for this is considered as follows. In the above-described copying machine, the charged toner is prevented from transferring to a non-image portion of the photoreceptor 101 by the potential difference between the developing sleeve 109 and the photoreceptor 101. In other words, the toner carried on the area of the developing sleeve 109 opposite to the non-image portion of the photoreceptor 101 in the developing region is attracted toward the developing sleeve 109. In this condition, the toner tends to be adhered to the developing sleeve 109 by an electric field directed toward the developing sleeve 109. The effect of the electric field that causes the toner to be attracted toward the developing sleeve 109 can be restrained to some degree by setting the developing gap (GP) to be at least about 0.35 mm, preferably at least about 0.4 mm. This is because, when the magnitude of a developing electric field is equal to the electric field that causes the toner to be attracted to the developing sleeve, the exertion of the developing electric field decreases as the developing gap (GP) increases. Further, according to the experimental results in FIGS. 5 and 6, the lower limit of the developing gap (GP) that does not cause the toner to be pressed against and fixed onto the surface of the developing sleeve 109 is about 0.35 mm.

In consideration of the above-described experimental results, the developing gap (GP) is set to about 0.35 mm or greater in the present embodiment. When the developing gap (GP) is too large, the exertion of the developing electric field decreases in the developing region, thereby causing the toner to be hard to transfer to an image portion of the photoreceptor 101. Therefore, in the present embodiment, the developing gap (GP) is set to about 2.0 mm or less to avoid the occurrence of the developing failure due to too large a developing gap (GP).

In addition to the above, it is found that the fixing of toner to the developing sleeve 109 is prevented by regulating the upper limit of the doctor blade gap (GD) relative to the developing gap (GP).

Figure 7:
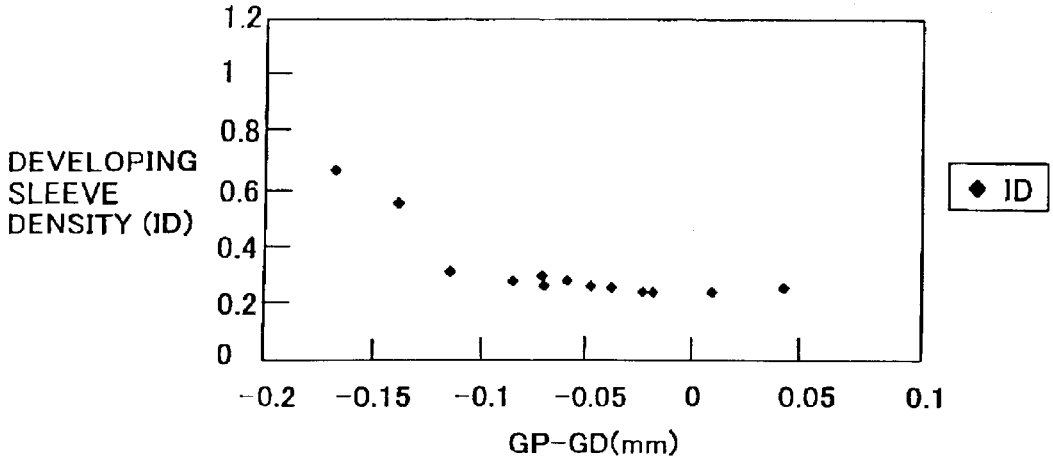
FIG. 7 is a graph showing a relationship between a developing sleeve density (ID) and a difference (GP−GD) between the developing gap (GP) and the doctor blade gap (GD) based on experimental results when using a new developer.
Figure 8:
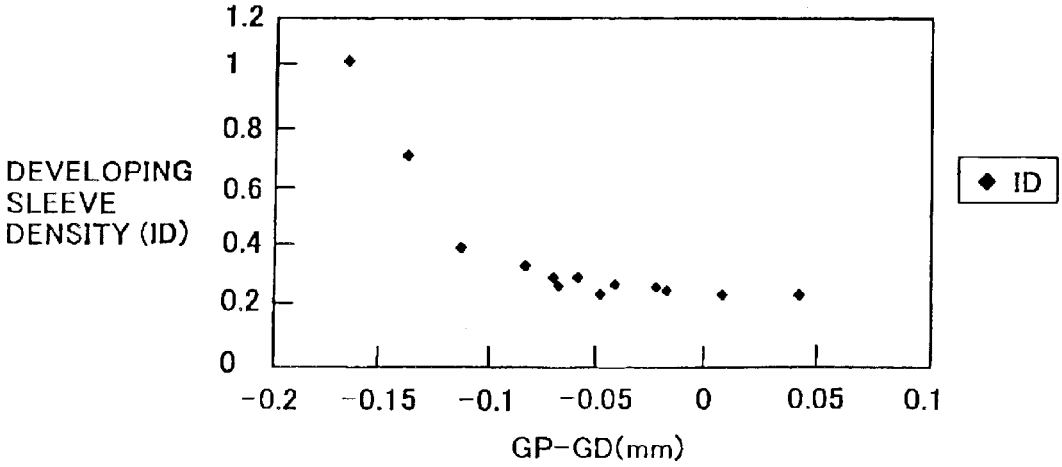
FIG. 8 is a graph showing a relationship between a developing sleeve density (ID) and a difference (GP−GD) between the developing gap (GP) and the doctor blade gap (GD) based on experimental results when using a developer that had been reused until 150,000 copies were produced.

Referring to FIGS. 7 and 8, the present inventor obtained the values of the developing sleeve density (ID) while changing the difference (GP−GD) between the developing gap (GP) and the doctor blade gap (GD) based on the experimental results in FIGS. 5 and 6. FIG. 7 is a graph showing a relationship between a developing sleeve density (ID) and the difference (GP−GD) between the developing gap (GP) and the doctor blade gap (GD) based on experimental results when using a new developer. FIG. 8 is a graph showing a relationship between a developing sleeve density (ID) and the difference (GP−GD) between the developing gap (GP) and the doctor blade gap (GD) based on experimental results when using a developer that had been reused until 150,000 copies were produced (hereafter referred to as a "reused developer").

Referring to FIGS. 7 and 8, it is found that there is a tendency between the difference (GP−GD) and the developing sleeve density (ID), even if the developing gap (GP) and the doctor blade gap (GD) are changed. In both FIGS. 7 and 8, when the difference (GP−GD) becomes less than −0.1 mm, the developing sleeve density (ID) sharply increases. Similarly as in the relationships of FIGS. 5 and 6, when the difference (GP−GD) is −0.1 mm when using the reused developer in FIG. 8, the value of the developing sleeve density (ID) is slightly higher than that of the developing sleeve density (ID) when using the new low-temperature developer in FIG. 7. According to the experimental results in FIGS. 7 and 8, it is found that when the difference (GP−GD) is greater than −0.1 mm, the superior effect of avoiding the fixing of low-temperature fixing toner to the developing sleeve 109 can be obtained in both cases of using the new low-temperature developer and the reused developer.

The reason for this is considered as follows. In the above-described copying machine, the doctor blade gap (GD) is set to be not substantially larger than the developing gap (GP). When the doctor blade gap (GD) is substantially greater than the developing gap (GP), the amount of developer supplied to the developing region increases, so that the developer that cannot enter the developing region remains at the upstream side of the developing region with respect to a direction in which the developing sleeve 109 conveys the developer. In this condition, when the charged developer is subjected to the stress and is influenced by the electric field while the developer remains at the upstream side of the developing region, the charging amount of the developer typically changes from a desired value. When such a developer enters the developing region, the developer may unexpectedly adhere to the developing sleeve 109, thereby causing the fixing of toner to the developing sleeve 109.

When the upper limit of the doctor blade gap (GD) is set to be greater than the developing gap (GP) by 0.1 mm, the oversupply of the developer to the developing region can be prevented. Thereby, the fixing of toner to the developing sleeve 109 can be avoided.

As described above, in this embodiment, the doctor blade gap (GD) and the developing gap (GP) are set such that the following relationship is satisfied:

$$GD<GP+0.1 \text{ mm},$$

where "GD" is a doctor blade gap between the doctor blade 112 and the surface of the developing sleeve 109, and "GP" is a developing gap between the developing sleeve 109 and the photoreceptor 101.

For example, the lower limit of the doctor blade gap (GD) may be set about 70% of the developing gap (GP). When the doctor blade gap (GD) is set to be less than 70% of the developing gap (GP), the amount of the developer supplied to the developing region becomes insufficient, thereby decreasing the image density.

As described above, in the copying machine according to the embodiment of the present invention, the developing gap (GP) is set to about 0.35 mm or greater. By setting the developing gap (GP) to about 0.35 mm or greater, the exertion of the developing electric field is restrained so as not to cause the toner to be pressed against and fixed onto the surface of the developing sleeve 109. In addition, the upper limit of the developing gap (GP) is set to about 2.0 mm to avoid the occurrence of the developing failure due to the decrease of exertion of the developing electric field in the developing region. By setting the developing gap (GP) to be in a range of about 0.35 mm to about 2.0 mm, even if a low-temperature fixing toner is used, the fixing of toner to the developing sleeve 109 can be prevented, so that the developing performance of the developing sleeve 109 can be maintained. As a result, a stable quality image can be obtained in the copying machine.

The present invention is applied to a single-color copying machine. Alternatively, the present invention can be applied to a multi-color copying machine.

Further, the present invention can be applied not only to a copying machine, but also to similar image forming apparatuses such as a printer, a facsimile machine, etc. or a multi-functional image forming apparatus.

Moreover, in place of the above-described low-temperature fixing toner, other toner may be used so long as a toner can be fixed at a low temperature.

Numerous additional modifications and variations of the present invention are possible in light of the above teachings. It is therefore to be understood that within the scope of the appended claims, the present invention may be practiced otherwise than as specifically described herein.

What is claimed:

1. An image forming apparatus comprising:

a latent image carrier configured to carry an electrostatic latent image on a surface of the latent image carrier;

a developer carrier configured to carry a two-component developer including a toner and magnetic particles on a surface of the developer carrier;

an electric field forming device configured to form a developing electric field to develop the electrostatic latent image on the latent image carrier with the toner in a developing region where the developer carrier faces the latent image carrier;

a magnetic brush formed by magnetically adsorbing the two-component developer onto the surface of the developer carrier, said latent image being developed with the toner in the magnetic brush while transferring the toner in the magnetic brush to the latent image; and a developing gap between the developer carrier and the latent image carrier in the developing region set so as not to press the toner in the magnetic brush against a surface of the developer carrier facing a non-image portion of the latent image carrier and set so as not to fix the toner onto the developer carrier, wherein the toner comprises at least a binder resin, a colorant, and a release agent, wherein the toner exhibits a peak molecular weight within a range of 1,000 to 10,000, and has a half peak width of 15,000 or less for a molecular weight distribution determined from a soluble content in tetrahydrofuran by gel permeation chromatography, and wherein the developing gap for a potential difference between said developer carrier and said latent image carrier in the developing region at most approximately 700 V satisfies a following condition:

$$0.35 \text{ mm} \leqq GP \leqq 2.0 \text{ mm},$$

where GP is the developing gap between the developer carrier and the latent image carrier in the developing region.

2. The image forming apparatus according to claim 1, further comprising:

a regulating member disposed opposite to the surface of the developer carrier and configured to regulate a layer thickness of the developer carried on the developer carrier, wherein a following condition is satisfied:

$$GD<GP+0.1 \text{ mm},$$

where GD is a regulating gap between the regulating member and the surface of the developer carrier.

3. The image forming apparatus according to claim 2, wherein the regulating member comprises a doctor blade.

4. An image forming apparatus comprising:

latent image carrying means for carrying an electrostatic latent image on a surface of the latent image carrying means;

developer carrying means for carrying a two-component developer including a toner and magnetic particles on a surface of the developer carrying means;

electric field forming means for forming a developing electric field to develop the electrostatic latent image on the latent image carrying means with the toner in a developing region where the developer carrying means faces the latent image carrying means;

a magnetic brush formed by magnetically adsorbing the two-component developer onto the surface of the developer carrying means, said latent image being developed with the toner in the magnetic brush while transferring the toner in the magnetic brush to the latent image; and a developing gap between the developer carrying means and the latent image carrying means in the developing region set so as not to press the toner in the magnetic brush against a surface of the developer carrying means facing a non-image portion of the latent image carrying means and set so as not to fix the toner onto the developer carrying means, wherein the toner comprises at least a binder resin, a colorant, and a release agent, wherein the toner exhibits a peak molecular weight within a range of 1,000 to 10,000, and has a half peak width of 15,000 or less for a molecular weight distribution is determined from a soluble content in tetrahydrofuran by gel permeation chromatography, and wherein the developing gap for a potential difference between said developer carrying means and said latent image carrying means is the developing region at most approximately 700 V satisfies a following condition:

$$0.35\ \text{mm} \leqq GP \leqq 2.0\ \text{mm},$$

where GP is the developing gap between the developer carrying means and the latent image carrying means in the developing region.

5. The image forming apparatus according to claim 4, further comprising:

regulating means for regulating a layer thickness of the developer carried on the developer carrying means, the regulating means being disposed opposite to the surface of the developer carrying means, wherein a following condition is satisfied:

$$GD < GP + 0.1\ \text{mm},$$

where GD is a regulating gap between the regulating means and the surface of the developer carrying means.

6. The image forming apparatus according to claim 5, wherein the regulating means comprises a doctor blade.

7. A method of forming an image in an image forming apparatus, comprising:

carrying an electrostatic latent image on a surface of a latent image carrier;

carrying a two-component developer including a toner and magnetic particles on a surface of a developer carrier;

forming a developing electric field to develop the electrostatic latent image on the latent image carrier with the toner in a developing region where the developer carrier faces the latent image carrier;

magnetically adsorbing the two-component developer onto the surface of the developer carrier in a shape of a magnetic brush; and developing the latent image with the toner in the magnetic brush while transferring the toner in the magnetic brush to the latent image, wherein a developing gap between the developer carrier and the latent image carrier in the developing region is set so as not to press the toner in the magnetic brush against a surface of the developer carrier facing a non-image portion of the latent image carrier and set so as not to fix the toner onto the developer carrier, wherein the toner comprises at least a binder resin, a colorant, and a release agent, wherein the toner exhibits a peak molecular weight within a range of 1,000 to 10,000, and has a half peak width of 15,000 or less for a molecular weight distribution is determined from a soluble content in tetrahydrofuran by gel permeation chromatography, and wherein the developing gap for a potential difference between said developer carrier and said latent image carrier in the developing region at most approximately 700 V satisfies a following condition:

$$0.35\ \text{mm} \leqq GP \leqq 2.0\ \text{mm},$$

where GP is the developing gap between the developer carrier and the latent image carrier in the developing region.

8. The method of claim 7, further comprising:

regulating a layer thickness of the developer carried on the developer carrier with a regulating member, wherein a following condition is satisfied:

$$GD < GP + 0.1\ \text{mm},$$

where GD is a regulating gap between the regulating member and the surface of the developer carrier.

9. An image forming apparatus comprising:

a latent image carrier configured to carry an electrostatic latent image on a surface of the latent image carrier;

a developer carrier configured to carry a two-component developer including a toner and magnetic particles on a surface of the developer carrier;

an electric field forming device configured to form a developing electric field to develop the electrostatic latent image on the latent image carrier with the toner in a developing region where the developer carrier faces the latent image carrier;

a magnetic brush formed by magnetically adsorbing the two-component developer onto the surface of the developer carrier, said latent image being developed with the toner in the magnetic brush while transferring the toner in the magnetic brush to the latent image; and a developing gap between the developer carrier and the latent image carrier in the developing region set so as not to press the toner in the magnetic brush against a surface of the developer carrier facing a non-image portion of the latent image carrier and set so as not to fix the toner onto the developer carrier, wherein the developing gap for a potential difference between said developer carrier and said latent image carrier in the developing region satisfies a following condition:

$$0.35\ \text{mm} \leqq GP,$$

where GP is the developing gap between the developer carrier and the latent image carrier in the developing region, and wherein the image forming apparatus further comprises a regulating member disposed opposite to the surface of the developer carrier and configured to regulate a layer thickness of the developer carried on the developer carrier, wherein a following condition is satisfied:

$$GD<GP+0.1 \text{ mm},$$

where GD is a regulating gap between the regulating member and the surface of the developer carrier.

10. An image forming apparatus comprising:

latent image carrying means for carrying an electrostatic latent image on a surface of the latent image carrying means;

developer carrying means for carrying a two-component developer including a toner and magnetic particles on a surface of the developer carrying means;

electric field forming means for forming a developing electric field to develop the electrostatic latent image on the latent image carrying means with the toner in a developing region where the developer carrying means faces the latent image carrying means;

a magnetic brush formed by magnetically adsorbing the two-component developer onto the surface of the developer carrying means, said latent image being developed with the toner in the magnetic brush while transferring the toner in the magnetic brush to the latent image; and a developing gap between the developer carrying means and the latent image carrying means in the developing region set so as not to press the toner in the magnetic brush against a surface of the developer carrying means facing a non-image portion of the latent image carrying means and set so as not to fix the toner onto the developer carrying means, wherein the developing gap for a potential difference between said developer carrying means and said latent image carrying means in the developing region satisfies a following condition:

$$0.35 \text{ mm} \leqq GP,$$

where GP is the developing gap between the developer carrying means and the latent image carrying means in the developing region, and wherein the image forming apparatus further comprises regulating means for regulating a layer thickness of the developer carried on the developer carrying means, the regulating means being disposed opposite to the surface of the developer carrying means, wherein a following condition is satisfied:

$$GD<GP+0.1 \text{ mm},$$

where GD is a regulating gap between the regulating means and the surface of the developer carrying means.

11. A method of forming an image in an image forming apparatus, comprising:

carrying an electrostatic latent image on a surface of a latent image carrier;

carrying a two-component developer including a toner and magnetic particles on a surface of a developer carrier;

forming a developing electric field to develop the electrostatic latent image on the latent image carrier with the toner in a developing region where the developer carrier faces the latent image carrier;

magnetically adsorbing the two-component developer onto the surface of the developer carrier in a shape of a magnetic brush; and developing the latent image with the toner in the magnetic brush while transferring the toner in the magnetic brush to the latent image, wherein a developing gap between the developer carrier and the latent image carrier in the developing region is set so as not to press the toner in the magnetic brush against a surface of the developer carrier facing a non-image portion of the latent image carrier and set so as not to fix the toner onto the developer carrier, wherein the developing gap for a potential difference between said developer carrier and said latent image carrier in the developing region satisfies a following condition:

$$0.35 \text{ mm} \leqq GP,$$

where GP is the developing gap between the developer carrier and the latent image carrier in the developing region, and wherein the method further comprises regulating a layer thickness of the developer carried on the developer carrier with a regulating member, wherein a following condition is satisfied:

$$GD<GP+0.1 \text{ mm},$$

where GD is a regulating gap between the regulating member and the surface of the developer carrier.

12. An image forming apparatus comprising:

a latent image carrier configured to have a latent image formed thereon; and a developer carrier configured to deliver a developer to the latent image on the latent image carrier to form a developer image in a developer region, the developer carrier separated from the latent image carrier by a developer gap, wherein the developer gap for a potential difference between the developer carrier and the latent image carrier is greater than or equal to 0.35 mm in the developer region, and wherein the image forming apparatus further comprises a regulating member configured to regulate a layer thickness of the developer carried on the developer carrier, wherein a regulating gap between the regulating member and the surface of the developer carrier is less than 0.1 mm more than the developer gap.

13. The image forming apparatus according to claim 12, wherein the developer gap is less than or equal to 2.0 mm.

14. The image forming apparatus according to claim 13, wherein the potential difference is at most approximately 700 V.

* * * * *